United States Patent [19]

Drader

[11] 4,165,003

[45] Aug. 21, 1979

[54] STACKABLE AND NESTABLE CONTAINERS

[76] Inventor: Clarence H. Drader, R.R. 2, South Edmonton, Alberta, Canada, T6C 4E6

[21] Appl. No.: 885,742

[22] Filed: Mar. 13, 1978

[51] Int. Cl.[2] ..... B65D 21/06

[52] U.S. Cl. ..... 206/506; 206/512; 206/517; 217/65; 220/72; 220/76; 220/DIG. 15

[58] Field of Search ..... 220/72, 7, 21, DIG. 15, 220/76; 206/509, 511, 512, 505, 506, 519, 517; 217/65

[56] References Cited

U.S. PATENT DOCUMENTS

| | | | |
|---|---|---|---|
| 2,535,256 | 12/1950 | Benson et al. | 220/7 X |
| 2,598,320 | 5/1952 | Tarbyfill | 206/505 X |
| 2,783,915 | 3/1957 | Gordon | 206/506 |
| 3,303,965 | 2/1967 | Parker et al. | 206/512 X |
| 3,361,292 | 1/1968 | Hulsman | 206/509 |
| 3,591,212 | 7/1971 | Rhyne | 220/76 X |
| 3,628,684 | 12/1971 | Sere | 220/72 X |
| 3,809,279 | 5/1974 | Arjas | 220/21 |
| 3,836,042 | 9/1974 | Petitto | 206/519 |
| 3,895,715 | 7/1975 | Drader | 206/506 |
| 3,997,055 | 12/1976 | Box | 206/509 X |
| 4,062,467 | 12/1977 | Friedrich | 220/7 |

FOREIGN PATENT DOCUMENTS

| | | | |
|---|---|---|---|
| 69217 | 4/1945 | Norway | 206/519 |

*Primary Examiner*—Allan N. Shoap
*Attorney, Agent, or Firm*—Fulwider, Patton, Rieber, Lee & Utecht

[57] ABSTRACT

A container having side walls mounted on a bottom panel for swinging movement between an upright position and an inclined position. Latch members movably mounted near the upper end of each side wall co-operate with the latch members of the adjoining walls normally to retain the latter walls in the upright position. Latch means in each side wall releasably interconnect the latch members of each side wall and is operable to release these latch members to allow the adjoining walls to move towards the inclined positions. Spring means to swing the side walls to the inclined positions when said walls are released.

21 Claims, 12 Drawing Figures

STACKABLE AND NESTABLE CONTAINERS

BACKGROUND OF THE INVENTION

This invention relates to containers which can be quickly and easily stacked, and having side walls that can be opened to permit the containers to be nested.

These containers may be used for any desired purpose, but they are primarily designed for carrying produce, liquid cartons or bottles, flexible containers such as milk pouches, and the like.

Containers having side walls normally latched in closed upright positions and releasable to swing outwardly to inclined nesting positions are known. For example, containers of this type are illustrated in U.S. Pat. No. 2,783,915 dated Mar. 5, 1957 and U.S. Pat. No. 3,895,715 dated July 22, 1975. The prior art containers have certain disadvantages. Containers of this type usually have to be handled quickly during loading and unloading operations and the consequent stacking and nesting operations. When a person wants to nest the prior containers, he operates latches of a first pair of opposed side walls and then latches on a second pair of opposed side walls so that the walls can be swung outwardly into inclined nesting positions. The operation of the latches of each pair of opposed side walls do not always release both side walls and/or the operator is not sure whether both are released until he releases the latches and then tries to swing the walls outwardly.

SUMMARY OF THE INVENTION

The present invention overcomes these disadvantages by providing latching means for the container side walls such that when one side wall is released, the opposed side wall is bound to be released. Furthermore, according to one aspect of the invention, the present containers have spring means for swinging the released side walls towards the nesting position so that the operator is instantly aware that the walls have been released.

Other features of the present container are strong side walls which are relatively light in weight, an ample "target" for stacking purposes with means to keep each carrier centrally located above the one immediately beneath it in the stack, intermeshing means at the corners formed by the side walls for preventing flexible packages, such as milk pouches, from protruding through the corners or causing the side walls to bulge outwardly at the corners.

According to one aspect of the invention, a container comprises: a rectangular bottom panel; side walls arranged in first and second opposed pairs and extending upwardly from the edges of the bottom panel, said side walls being mounted to swing between closed upright positions and outwardly inclined nesting positions relative to the bottom panel; latch members movably mounted on each side wall near the top thereof and extending towards corners of the container formed by said each side wall and the two mutually opposing side walls adjacent thereto, each of said latch members having inner and outer ends with the outer ends thereof joined to the outer ends of the adjacent latch members of said two adjacent side walls at said corners; latch means releasably interconnecting the inner ends of the latch members of each side wall to prevent movement thereof and thereby lock the two mutually opposing side walls adjacent said each side wall in the upright position, said latch means being operable to release the inner ends of the latch members interconnected thereby to free said two adjacent side walls for movement towards the nesting position; and spring means mounted to swing each side wall towards the nesting position when each side wall is free to move.

According to another aspect of the invention, the latch means comprises means on the inner end of each of the latch members of each side wall, said means being shaped to interconnect when moved into engagement with each other and to release each other disengaged from each other.

The latch means on the inner ends of each latch member may be a hook, the hooks being disengaged from each other when the inner end of one of the latch members is moved transversely relative to the inner end of the other of the latch members.

Examples of this invention are illustrated in the accompanying drawings in which:

FIG. 1 is a perspective view of a preferred embodiment of the invention shown with the side walls in the closed upright position, FIG. 2 is similar to FIG. 1 but showing the side walls in the inclined nesting position, FIG. 3 is a horizontal section through a side wall of the container and taken on line 3—3 of FIG. 1, FIG. 4 is a vertical section through a side wall, FIG. 5 is an enlarged section through the bottom portion of one container stacked on the upper portion, of another container, FIG. 6 is a fragmentary and sectional view of two nested containers, FIG. 7 is a fragmentary view of a corner of one container positioned above a corner of another container, FIG. 8 illustrates one of the springs which swings the walls associated with it towards the nesting position, FIG. 9 diagrammatically illustrates the latch system of the preferred form of the invention, FIG. 10 is an enlarged sectional detail of the latch members of a side wall in the unlatched position, FIG. 11 diagrammatically illustrates an alternative form of latch system, and FIG. 12 is an enlarged detail of the latch members of the alternative of FIG. 11, including a portion of a side wall modified to receive this alternative.

DESCRIPTION OF THE PREFERRED EMBODIMENTS

Figure 1:
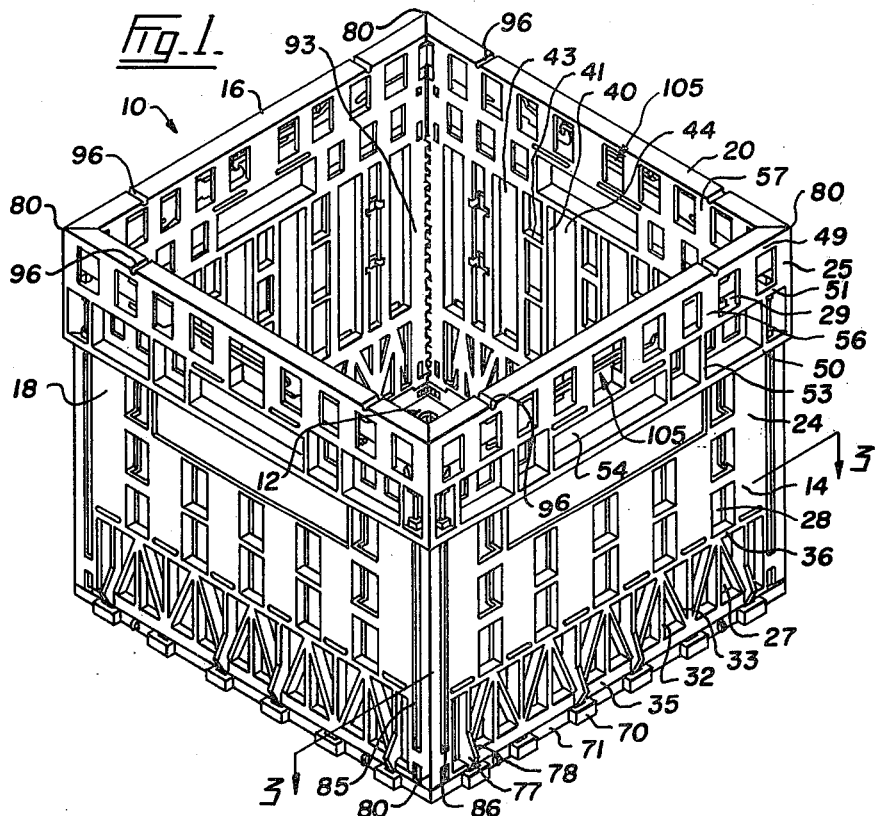

Referring to FIGS. 1 to 10 of the drawings, 10 is a preferred form of container in accordance with this invention. This container has a bottom panel 12 and an opposed pair of side walls 14 and 16, and another pair of opposed side walls 18 and 20. The bottom panel and the side walls are made of any suitable strong and light weight material, such as wood, aluminum or plastic. Plastic is preferred since it can easily be molded and is strong and durable and resistant to corrosion. Plastics such as polyethylene, polypropylene, p.v.c. or a.b.s. can be used. As the four walls 14, 16, 18 and 20 are identical in construction, only one, namely wall 14, will now be described in detail.

The side wall 14 is made up of a main panel 24 with an enlarged section 25 at the top and extending the width thereof. The illustrated wall is formed of plastic, and in order to lighten the wall and to reduce the amount of plastic required, said wall is formed with lightening holes 27 and 28 in the main panel and lightening holes 29 in section 25. For strength purposes, the lower portion of panel 24 is formed by vertical ribs 32 alternating with inclined ribs 33, these ribs extending between horizontal rails 35 and 36.

Figure 2:
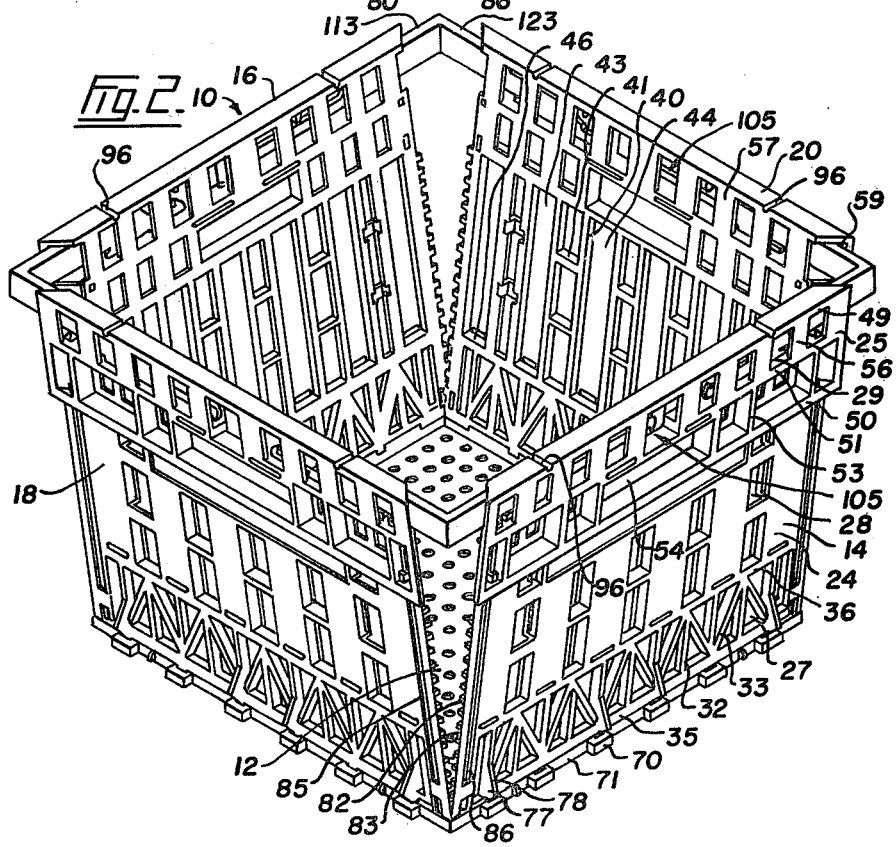

The central portion of main panel 24 is formed by vertical ribs 40 and cross ribs 41 extending therebetween, see FIG. 2. The outer edges of pairs of these ribs 40 are interconnected by webs 43, said ribs and the webs connected thereto form inner vertical channels 44 extending upwardly from rail 36. The portions of rail 36 at the lower ends of webs 43 and the vertical ribs 40 connected thereto form inner shoulders 46, see the inner surface of side wall 20 in FIGS. 1 and 2.

The enlarged section 25 of the side wall having increased thickness is formed by horizontal upper and lower rails 49 and 50 and a horizontal intermediate rail 51. Vertical ribs 53 extend between rails 50 and 51, and a hand hole 54 is provided in wall section 25 between the rails 50 and 51. A plurality of outer webs 56 extend between rails 49 and 51 at the outer surface of the wall, and a plurality of inner webs 57 extend between these rails at the inner surface of the walls, the webs 56 and 57 being alternately arranged relative to each other and forming a horizontal passage 59 therebetween.

The specified rib and web arrangement of the side wall is not essential to the operation of the container, but the combination provides a very strong but light in weight wall of pleasant appearance using a minimum of material. The ribs 32, 33, 40 and 53, and the webs 56 and 57 in effect form rigid supports extending from the upper edge to the lower edge of the wall.

Figures 3, 4, 5, 6, 7:
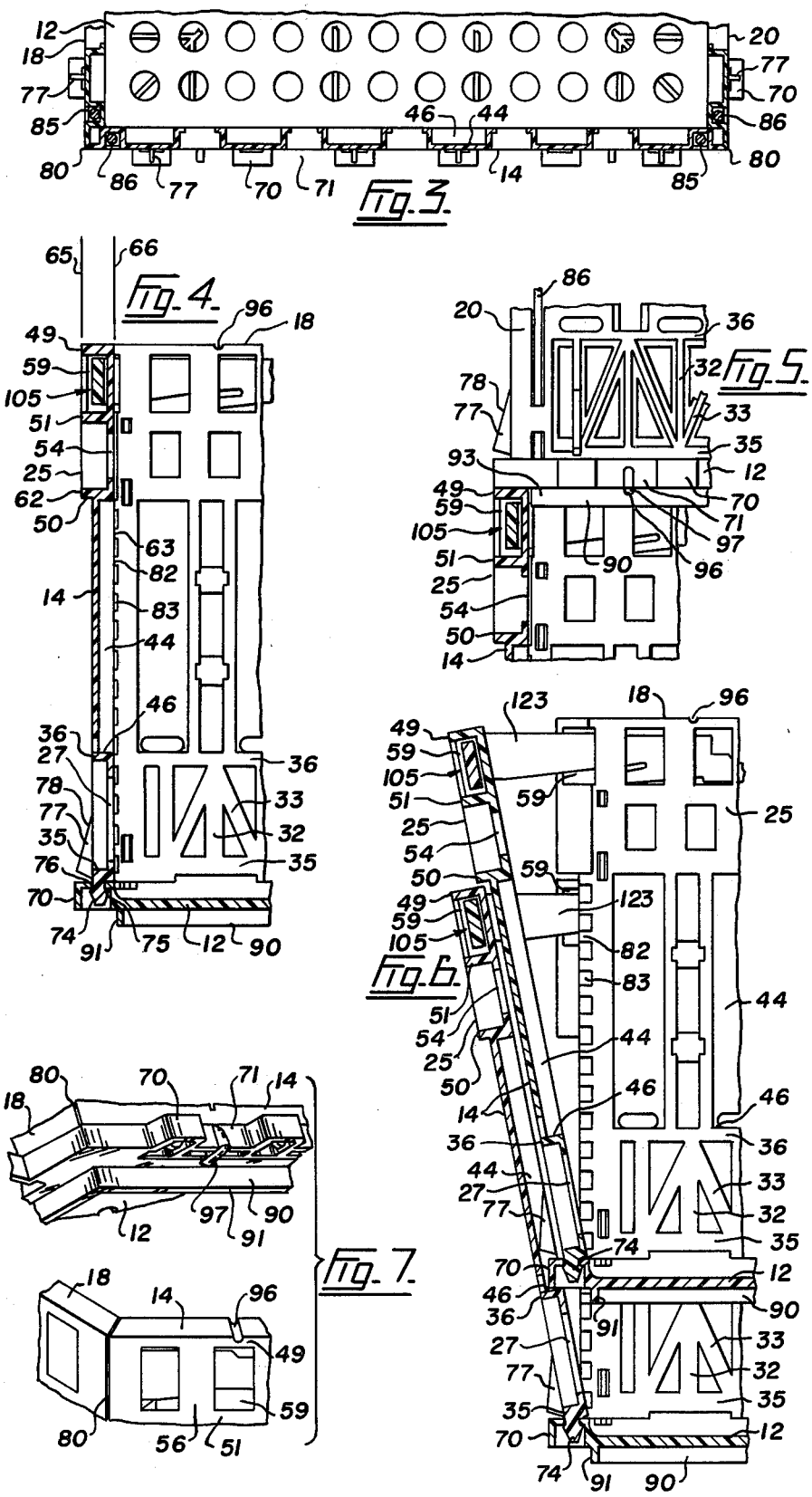
Figure 8:
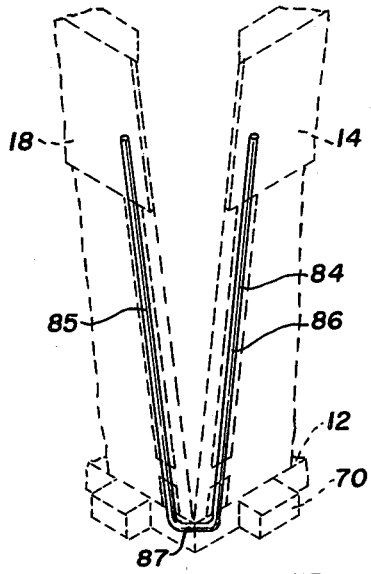

The outer surface 62 and the inner surface 63 of the side wall, see FIG. 4, are located between outer and inner planes 65 and 66 which indicated the maximum thickness of the wall.

As stated above, shoulder means is provided at the inner side of wall 14, this shoulder means being formed by an interrupted inner shoulder made up of shoulders 46. Corresponding outer shoulder means is provided along the adjacent edge of bottom panel 12. This outer shoulder means consists of shoulder sections 70 projecting outwardly from the panel edge with spaces 71 therebetween. Each outer shoulder section 70 is below an inner shoulder 46 and is of such width as to be able to slide in a vertical channel 44 of a similar container when the containers are nested. By referring to FIG. 4, it will be seen that the shoulder sections 70 are within the planes 65 and 66 of the side wall, as are the inner shoulders 46. Thus, although outer shoulders 70 project laterally outwardly from the bottom panel of the container, they do not increase the overall cross section area of the container. Furthermore, the inner channels 44 do not weaken their respective walls because of the vertical ribs 40 and webs 43 of these walls.

Side wall 14 is formed with a plurality of laterally spaced tongues 74 which extend down into sockets 75 formed within shoulder sections 70 properly to position the lower edge of the wall on the bottom panel at the edge thereof. Each tongue 74 is formed with relatively small shoulders 76 projecting laterally therefrom normally to prevent the tongue from being withdrawn from its socket. A vertical vane-like deflector 77 is provided on the outer surface of the side wall immediately above each of the shoulder sections 70. Each deflector has an inclined edge 78 which extend outwardly and downwardly from the wall and terminates just above the shoulder section 70 therebeneath at the outer edge thereof, see FIGS. 1, 2 and 4. These deflectors prevent any object brushing down the outer surface of the wall from hitting the shoulder sections with the danger of breaking them off and also prevent collision of the upper edge of shoulder 70 with rail 50 upon withdrawal of nested containers.

When the side walls 14, 16, 18 and 20 are in their upright positions, their adjacent ends form the four corners 80 of the container. At each corner 80, the side edges of the walls are formed with intermeshing tongues and slots 82 and 83. The tongues of one wall fit into the slots of the adjacent wall in order to brace the walls at the corner and to help prevent flexible packages from protruding through the corners.

A U-shaped steel reinforcing rod 84 is provided at each corner 80 of the container. This rod has diverging legs 85 and 86 extending upwardly from a base bar 87, see FIG. 8. The base bar extends across the corner on or in the adjacent corner of bottom panel 12, and the legs 85 and 86 extend upwardly through the two side walls forming the corner, these rods extending to near the upper edges of the walls. The legs act as reinforcing bars on opposite sides of the corner to help to prevent the walls from bowing outwardly at the corner. In addition to this, the legs are in their natural diverging position when the side walls are inclined outwardly in the nesting position. As a result, when the walls are swung inwardly to their upright positions, these legs are put under tension. Consequently, when the side walls are released, the legs automatically swing them outwardly.

Bottom panel 12 is formed with a large downwardly extending rectangular projection 90 having sides 91 spaced inwardly a little relative to the inner plane 66 of each side wall, see FIG. 4. The inner surfaces of the side walls of the container form a relatively large opening 93 at the top of the container. The bottom projection 90 is of such size that it fits freely into the opening 93 of a container therebeneath when the containers are stacked. The opening 93 provides a large target for the bottom projection 90 so that one container can be very quickly placed on another usually in its proper stacking position. The bottom projection 90 is smaller than opening 93 to permit quick stacking. As a result, the containers may not always end up exactly in the proper stacking position. Therefore, the upper edge of each side wall is provided with a plurality of grooves 66 extending laterally thereon and bottom panel 12 is formed with a plurality of corresponding ridges 97 near its four side edges, see FIG. 7. The projection 90 at least locates the two stacked containers almost in their proper positions, and a slight movement to the upper container will cause the bottom ridges 97 to fit over grooves 96 to retain the containers in proper vertical alignment.

Figure 9:
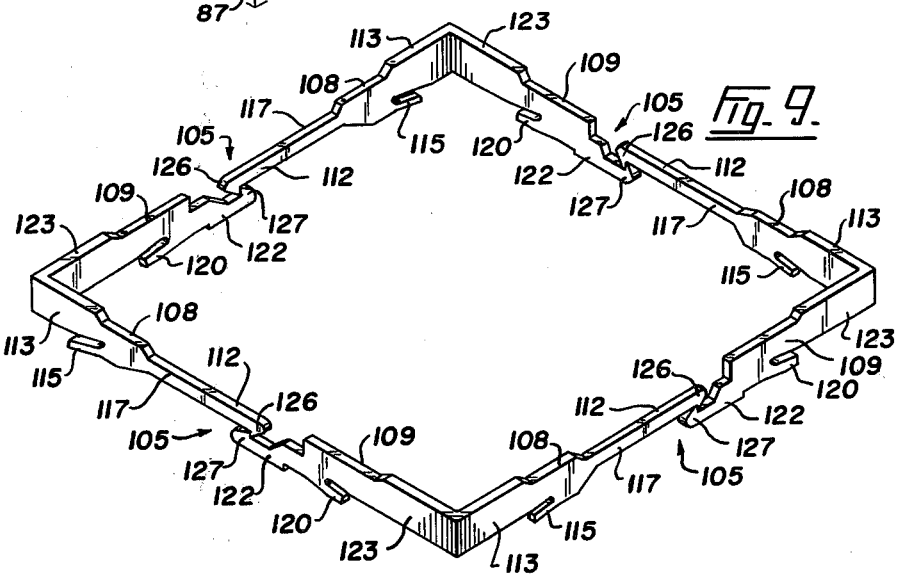
Figure 10:
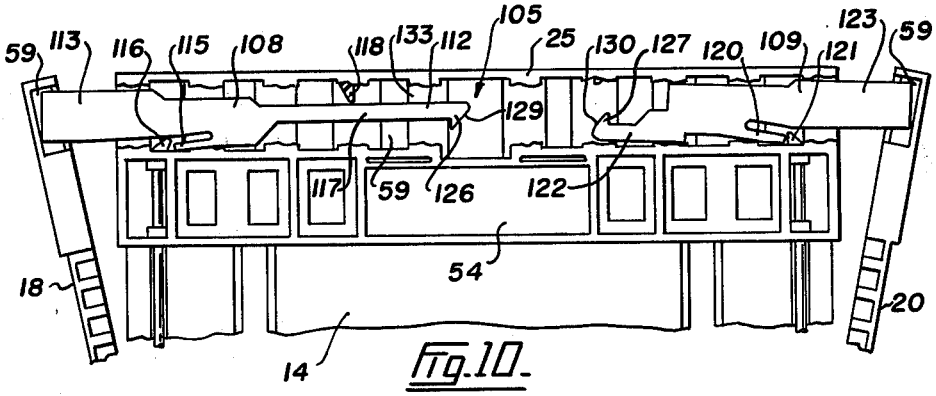

A latch 105 is provided for each of the four side walls. Each latch 105 is mounted in a side wall near the upper edges thereof, but its purpose is to latch and unlatch the two mutally opposed side walls adjacent said said wall. Latch 105 is shown in detail in FIGS. 9 and 10, FIG. 10 showing the latch in wall 14 for walls 18 and 20.

Each latch 105 includes elongate latch members 108 and 109 which are slidably mounted in passage 59 of its side wall and extend longitudinally thereof. The bottom, top and sides of passage 59 act as guide means to contain said members 108 and 109 for movement towards and away from each other. Latch member 108 has an inner end 112 and an outer end 113, and in this example, latch member 108 has a foot 115 on its lower edge which slides along the bottom of passage 59 and engages a stop 116 on said bottom to limit the outward movement of said latch member. The inner portion of the latch member is in the form of a slender rod 117 which is slightly flexible and extends beneath a bar 118 extending across the passage above the rod and secured to the sides of the passage.

Latch member 109 has a foot 120 on its lower edge resting on the bottom of passage 59 and positioned to engage an outward limiting stop 121 on said bottom. Member 109 has an inner end 122 and an outer end 123. It will be noted that the outer end 113 of one latch member 108 is integrally rigidly connected to the outer end 123 of the adjacent latch member 109 in the adjacent wall, see FIG. 9.

Latch means releasably interconnects the inner ends of latch member 108 and 109 of the latch 105 in each wall. In container 10, the latch means comprises cooperating hooks 126 and 127 on the inner ends of latch members 108 and 109, respectively, said hooks interconnecting when moved into engagement with each other. Hooks 126 and 127 are provided with bevels 129 and 130 on their outer surfaces which engage when the latch members are moved towards each other. As rod 117 is resilient, its hook 126 slides up the bevel of hook 127 until it drops behind the latter hook. When hooks 126 and 127 are in engagement, as in FIG. 9, the latch 105 of wall 14 retains the walls 18 and 20 in their upright positions. To release these walls, all the operator has to do is insert a finger in an opening 133, formed in the side wall for this purpose, beneath rod 117 and then to raise the end of this rod sufficiently to clear hook 126 from hook 127. When the hooks are disengaged, the U-rods 84 between the ends of wall 14 and the adjacent ends of walls 18 and 20 swing the latter two walls outwardly towards the inclined nesting position. One of the advantages of latch 105 is that when one side wall is freed, the opposing side wall also is freed since you cannot free hook 126 without freeing hook 127. Other latch means besides the hooks are within the scope of the invention.

By referring to FIG. 9, it will be seen that the latch member 108 of each wall is integrally connected to the latch member 109 of the adjacent wall. This enables these two latch members to be molded in one piece and operation, and four of these units make up the latch system of containers 10. The latch members 108 and 109 can be of any desired shape as long as they are provided with the hooks 126 and 127 at their inner ends, and latch 108 is formed with the slightly resilient rod 117. By referring to FIG. 10 it will be seen that the bar 118 is in a position normally to prevent the two hooks from disengaging. In order to make the disengagement, the free end of rod 117 has to be bent upwardly to clear its hook from hook 127.

When the container 10 is in use, the side walls 14, 16, 18 and 20 thereof are retained in their upright positions by latches 105. When it is desired to stack one container on another, the upper container is placed over the lower one with its bottom projection 90 fitting into the opening 93 at the top of the lower container. As stated above, the sloppy fit of the projection into the open top makes it easy to quickly place the upper container in position. If the upper container is not exactly in the right position, a slight amount of movement of this upper container will cause the grooves 96 of the lower container to enter the ridges 97 of the upper container to position the two containers in exact alignment.

When it is desired to nest the containers, the operator grasps two opposed side walls at the hand holes 54 thereof, inserts fingers in the openings 133 of these walls and disengages the hooks of the latches 105. As soon as the latches are disengaged, the U-rods 84 swing the opposed side walls outwardly towards the inclined nesting position. Then the operator grasps the latter two walls and operates the latches thereof to free the first two walls which then swing towards the nesting position. Stops 116 and 120 in the wall passages prevent the walls from swinging outwardly beyond the proper nesting position.

When it is desired to nest two containers, the operator places one of these opened containers within another opened one. The upper containers moves downwardly in the lower container and its shoulder sections 70 ride down the inner channels 44 of the lower container at this time until the shoulder sections rest on shoulders 46. These shoulders prevent the upper container from moving downwardly until it jams in the lower container. As a result, the containers can be taken apart very easily. A high stack of nesting containers can be made since there is no danger of the containers jamming regardless of the weight on them.

FGIS. 11 and 12 illustrate an alternative form of latch 140 for container 10. Latch 140 includes latch members 145 and 146 extending longitudinally of the passage 59 of the side wall of the container. Latch member 145 has inner and outer ends 148 and 149. Similarly, latch member 146 is formed with inner and outer ends 151 and 152. The outer end 149 of each latch member 145 is integrally rigidly connected to the outer end 152 of the adjacent latch member 146. The latch members 145 and 146 are formed with hooks 155 and 156 on their inner ends. Leaf springs 158 and 159 mounted in the container side wall engage shoulders 161 and 162 of members 145 and 146 normally to urge said members away from each other to shift the adjacent mutually opposed side walls towards the inclined nesting position.

Figure 11:
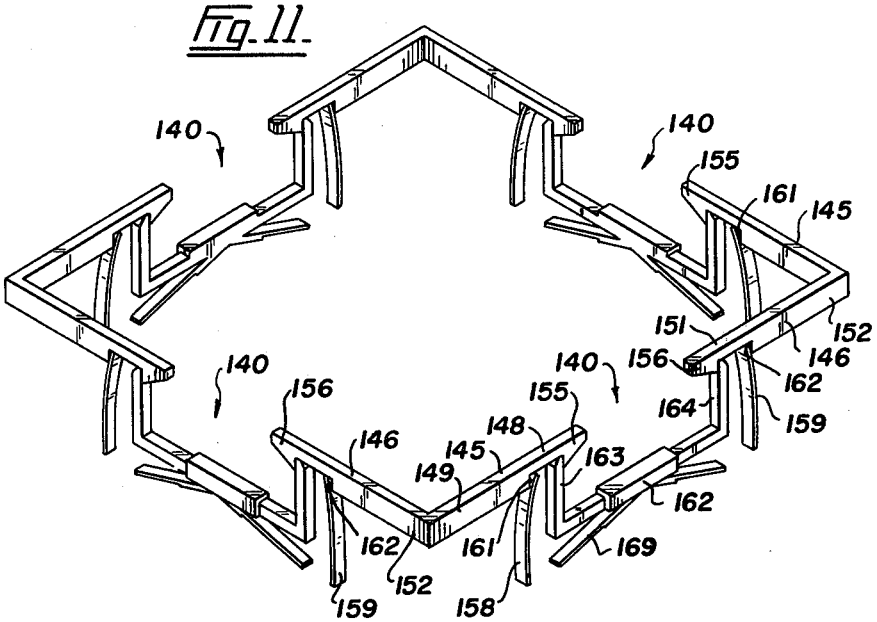
Figure 12:
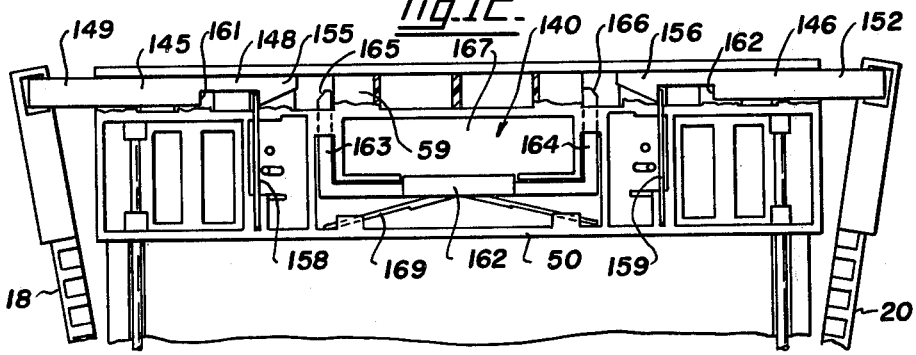

Latch means releasably interconnects the hooks 155 and 156. In this example, the latch means is in the form of a U-shaped bar 162 with upwardly extending legs 163 and 164, said legs having hooks or stops 165 and 166 on their upper ends. Bar 162 and its legs extend around a relatively large hand hole 167 formed in the side wall for this purpose. Spring members 169 bearing against bar 162 and the rail 50 of the side wall normally urge the U-shaped bar upwardly a limited distance into an upper position at which time its hooks 165 and 166 engage the latch member hooks 155 and 156, see FIG. 11, to prevent the latch members from moving away from each other and consequently retaining the adjacent mutually opposed side walls in the upright position. Springs 158 and 159 are under tension at this time. When the operator depresses the U-bars 162 of two opposing side walls, the hooks 165 and 166 clear hooks 155 and 156 to allow springs 158 and 159 to move the latch members 145 and 146 outwardly, thereby moving the adjacent side walls towards the nesting position. These springs at this time engage inner portions of hooks 155 and 156 to limit the outward movement of the opposed side walls.

The container with latches 140 functions in the same manner as the container described above. The latches 140 are the only material differences involved.

What I claimed is:

1. A container that can be quickly stacked and deeply nested, comprising:

a rectangular bottom panel;

side walls arranged in first and second opposed pairs and extending upwardly from edges of the bottom panel, each side wall having a top, a bottom, two vertical ends, and two mutually opposing side walls adjacent thereto, said side walls being mounted to swing between closed upright positions and outwardly inclined nesting positions relative to the bottom panel;

two latch members movably mounted on each side wall near the top thereof, each latch member having an inner end and an outer end, the outer end being near one of the vertical ends of said each side wall, the outer end of each latch member being rigidly interconnected to the outer end of an adjacent said latch member of one of the adjacent side walls;

latch means near the inner ends of the latch members for mutually and releasably interconnecting the inner ends of the latch members of each side wall to prevent movement thereof and thereby lock the two mutually opposing side walls adjacent said each side wall in the upright position, said latch means being operable to release the inner ends of the latch members interconnected thereby to free said two adjacent side walls for movement towards the nesting position; and spring means mounted for urging each side wall to swing automatically from said upstanding positions to said nesting positions when each side wall is free to move by the releasing of said latch members.

2. A container as claimed in claim 1 wherein the latch members of each side wall are mounted for longitudinal movement, and comprising guide means in each side wall for the latch members thereof to constrain said members for movement towards and away from each other.

3. A container as claimed in claim 2 wherein the latch means interconnecting the latch members of each side wall comprises a hook on the inner end of each of the latch members of said each side wall, said hooks being shaped to interconnect when moved into engagement with each other and to release each other when the inner end of one of said latch members is moved transversely relative to the inner end of the other of said latch members.

4. A container as claimed in claim 2, wherein the latch means interconnecting the latch members of each side wall comprises a hook on the inner end of the latch members of said each side wall, a handle mounted on the side wall for vertical movement and biased to an upper position, and fingers secured to the handle and extending upwardly to engage the hooks when the handle is in the upper position, to prevent the latch members from moving away from each other, the fingers disengaging the hooks when the handle is depressed to free the latch members.

5. A container as claimed in claim 4, the spring means comprising two leaf springs mounted in each container side wall, each leaf spring engaging a shoulder on a latch member.

6. A container as claimed in claim 1 in which said spring means comprises a stiff U-shaped reinforcing rod at each corner of the container, the rod at each of said corners having normally diverging legs extending upwardly from a base bar of the U extending across said each corner near lower edges of the adjacent side walls forming said each corner, said legs extending upwardly along said adjacent side walls and being secured to the respective side walls, whereby when said adjacent side walls are moved to their upright positions, tension is applied to the legs secured thereto which is sufficient to move said adjacent side walls towards their inclined nesting positions when the side walls are released.

7. A container as claimed in claim 1, the side walls comprising:

a lower portion formed by vertical ribs alternating with inclined ribs;

a central portion formed by vertical ribs and cross ribs extending therebetween, the outer edges of pairs of the ribs being interconnected by webs, the ribs and webs connected thereto forming inner vertical channels; and an upper portion of increased thickness formed by horizontal upper, lower and intermediate rails with vertical ribs extending between the lower and the intermediate rails and a hand hole therebetween, a plurality of outer webs extending between the upper and the intermediate rails at the outer surface of the wall, and a plurality of inner webs extending therebetween at the inner surface of the wall, the inner and outer webs being alternately arranged relative to each other and forming a horizontal passage therebetween providing guide means for longitudinal movement of the latch members.

8. A container as claimed in claim 7, in which the spring means comprises a stiff U-shaped reinforcing rod at each corner of the container, the rod at each of the corners having normally diverging legs extending upwardly from a base of the U extending across said each corner near lower edges of the adjacent side walls forming said each corner, the legs extending upwardly along the adjacent side walls and being secured to the respective side walls, whereby, when the adjacent side walls are moved to their upright positions, tension is applied to the legs secured thereto which is sufficient to move the adjacent side walls towards their inclined nesting positions when the side walls are released.

9. A container as claimed in claim 7, wherein the latch means interconnecting the latch members of each side wall comprises a hook on the inner end of each of the latch members of said each side wall, the hooks being shaped to interconnect when moved into engagement with each other and to release each other when the inner end of one of the latch members is moved transversely relative to the inner end of the other of the latch members.

10. A container as claimed in claim 9, including:

outer shoulder sections with spaces therebetween on each of the edges of the lower portions of the side walls and projecting outwardly;

inner shoulder sections on each said side wall at the bottom of the vertical channels of the central portion and projecting inwardly of said each side wall, the outer and inner shoulder sections being positioned so that the outer shoulder sections of one container nested in another similar container rests on the inner shoulder sections of the similar container;

and a vertical deflector on each side wall extending upwardly from each outer shoulder section thereof.

11. A container as claimed in claim 7, in which each side wall has a lower edge resting on the bottom panel at an edge thereof, and including sockets in the bottom panel along each edge thereof, and tongues on the lower edge of each side wall positioned to fit in the bottom panel sockets therebeneath.

12. A container as claimed in claim 1, comprising matching ridges and grooves on the upper edges of the side walls and the bottom panel near the side edges thereof to interfit when one container is stacked on a similar container with the sides thereof in the upright position, the ridges and grooves preventing the containers from shifting horizontally relative to each other.

13. A container as claimed in claim 1, comprising intermeshing tongues and slots along the vertical side edges of the side walls forming each corner of the container.

14. A container that can be quickly stacked and deeply nested, comprising:

a rectangular bottom panel;

side walls arranged in first and second opposed pairs and extending upwardly from the edges of the bottom panel, each side wall having a top, a bottom, two vertical ends and two mutually opposing side walls adjacent thereto, the side walls being mounted to swing from closed upright positions to outwardly inclined nesting positions relative to the bottom panel;

two latch members movably mounted on each side wall near the top thereof, each latch member having an inner end and an outer end, the outer end being near one of the vertical ends of said each side, the outer end of each latch member being rigidly interconnected to the outer end of an adjacent said latch member of one of the adjacent side walls;

latch means near the inner ends of the latch members for mutually and releasably interconnecting the inner ends of the latch members of said each side wall, to prevent movement thereof and thereby lock the two mutually opposing side walls adjacent said each side wall in the upright position, said latch means being operable to release the inner edges of the members interconnected thereby to free said two adjacent side walls for movement towards the nesting position.

the latch means comprising a hook on the inner end of each latch member, the hooks of each side wall being shaped to interconnect when moved into engagement with each other and to disengage from each other when the inner end of one of the latch members is moded transversely relative to the inner end of the other latch member; and spring means mounted for urging each side wall to swing automatically from said upstanding positions to said nesting positions when each side wall is free to move by the releasing of said latch members.

15. A container as claimed in claim 14, in which said spring means comprises a stiff U-shaped reinforcing rod at each corner of the container, the rod at each of the corners having normally diverging legs extending upwardly from a base bar of the U extending across said each corner near lower edges of the adjacent side walls forming said each corner, the legs extending upwardly along the adjacent side walls and being secured to the respective side walls, whereby, when the adjacent side walls are moved to their upright positions, tension is applied to the legs secured thereto which is sufficient to move the adjacent side walls towards their inclined nesting positions when the side walls are released.

16. A container as claimed in claim 14, wherein the latch members of each side wall are mounted for longitudinal movement, and the latch means interconnecting the latch members of each side wall comprise a hook on the inner end of each of the latch members of said each side wall, a handle mounted on the side wall for vertical movement and biased into an upper position, and fingers secured to the handle and extending upwardly to engage the hooks when a handle is in the upper position, to prevent the latch members from moving away from each other, the fingers disengaging the hooks when the handle is depressed to free the latch members.

17. A container as claimed in claim 16, the spring means comprising two leaf springs mounted in each said container side wall and engaging shoulders of the latch members.

18. A container as claimed in claim 14, the side wall comprising:

a lower portion formed by vertical ribs alternating with inclined ribs;

a central portion formed by vertical ribs and cross ribs extending therebetween, the outer edges of pairs of the ribs being interconnected by webs, the ribs and webs connected therebetween forming inner vertical channels; and an upper portion of increased thickness formed by horizontal upper, lower and intermediate rails with vertical ribs extending between the lower and intermediate rails and a hand hole therebetween, a plurality of outer webs extending between the upper and intermediate rails at the outer surface of the wall, and a plurality of inner webs extending therebetween at the inner surfaces of the walls, the inner and outer webs being alternately arranged relative to each other and forming a horizontal passage therebetween providing guide means for longitudinal movement of the latch members.

19. A container as claimed in claim 18, comprising intermeshing tongues and slots along the vertical side edges of the side walls forming each corner of the container.

20. A container as claimed in claim 14, comprising matching ridges and grooves on the upper edges of the side walls and the bottom near the side edges thereof to interfit when one container is stacked on a similar container with the sides thereof in the upright position, the ridges and grooves preventing the containers from shifting horizontally relative to each other.

21. A container as claimed in claim 14, comprising intermeshing tongues and slots along the vertical side edges of the side walls forming each corner of the container.

* * * * *